United States Patent [19]

Adams et al.

[11] 4,076,459

[45] Feb. 28, 1978

[54] HORSEPOWER LIMITER CONTROL FOR A VARIABLE DISPLACEMENT PUMP

[75] Inventors: Cecil E. Adams; Leo H. Dillon; Ellis H. Born; David L. Thurston, all of Columbus, Ohio

[73] Assignee: Abex Corporation, New York, N.Y.

[21] Appl. No.: 723,107

[22] Filed: Sep. 14, 1976

[51] Int. Cl.[2] ..... F04B 49/08

[52] U.S. Cl. ..... 417/217; 60/452; 417/218

[58] Field of Search ..... 417/218–222, 417/217; 60/445, 452

[56] References Cited

U.S. PATENT DOCUMENTS

| | | | |
|---|---|---|---|
| 3,877,839 | 4/1975 | Ifield | 417/222 X |
| 3,908,519 | 9/1975 | Born et al. | 417/222 X |
| 3,967,541 | 7/1976 | Born et al. | 91/506 X |
| 3,982,470 | 9/1976 | Adams et al. | 91/506 |

*Primary Examiner*—William L. Freeh
*Assistant Examiner*—Edward Look
*Attorney, Agent, or Firm*—Thomas S. Baker, Jr.; David A. Greenlee

[57] ABSTRACT

A horsepower limiter control for an axial piston pump provides a simple adjustment for setting the maximum horsepower the pump can provide and automatically adjusts the product of working pressure and maximum pump displacement to maintain the set horsepower. The horsepower limiter control operates to reduce the displacement of the pump when working fluid pressure exceeds the setting of the sequence valve.

11 Claims, 7 Drawing Figures

Fig. 2
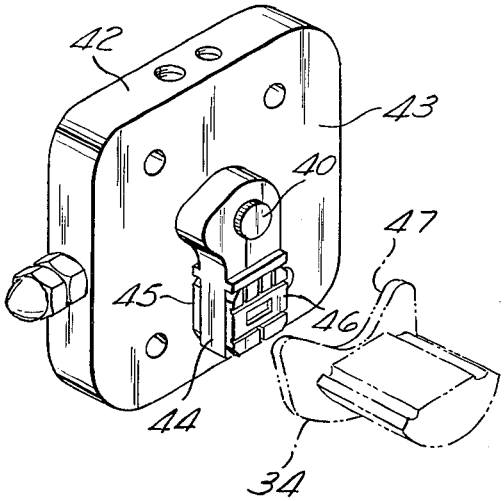
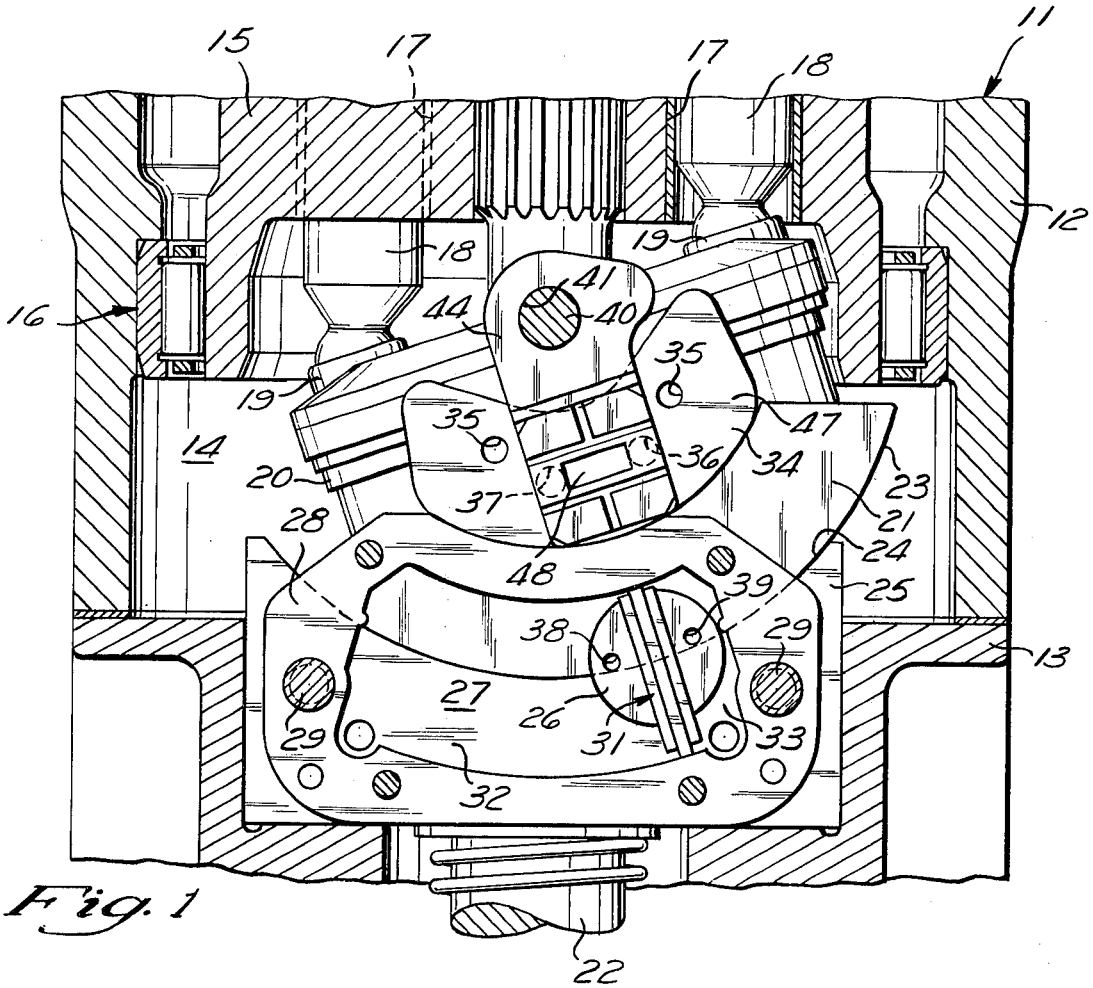
Fig. 1

Fig. 5
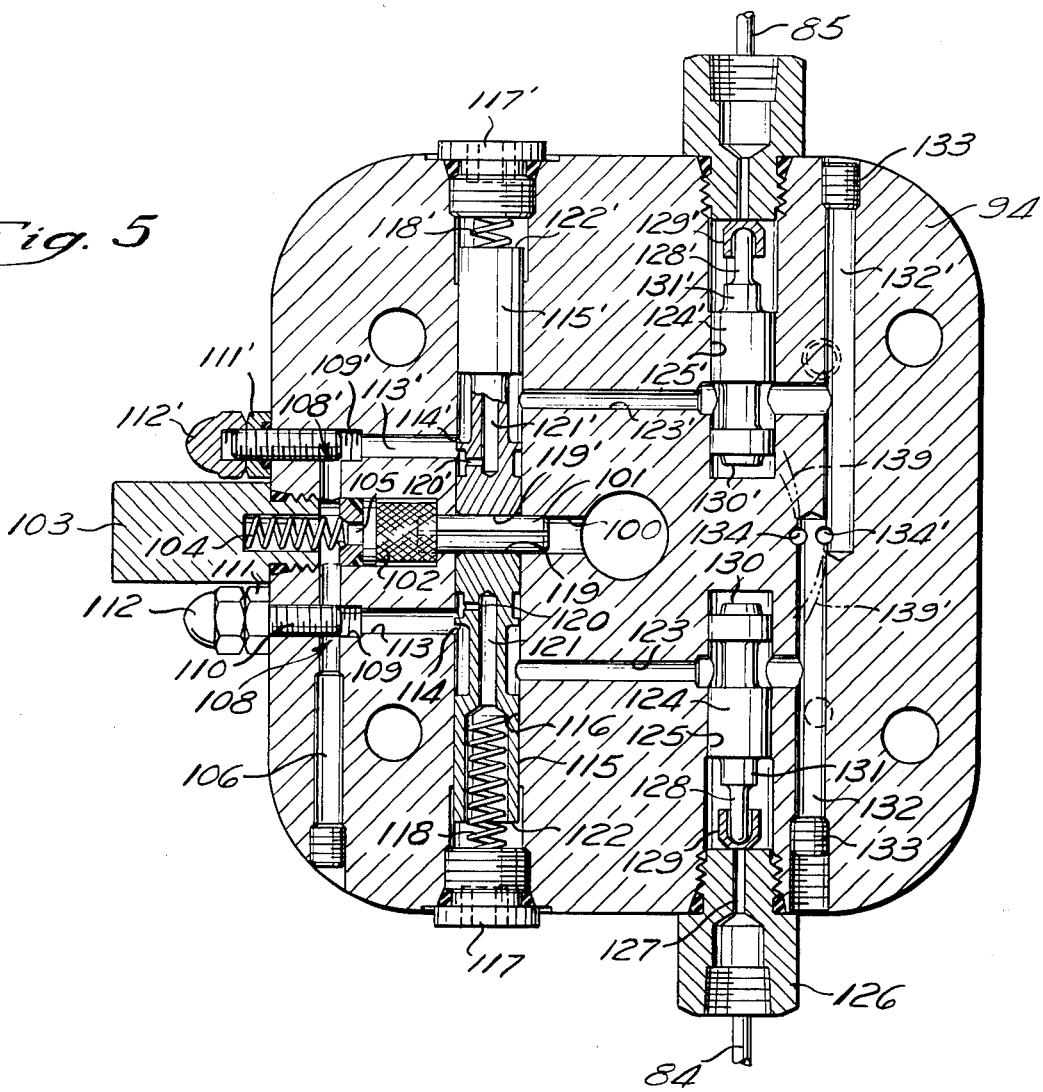
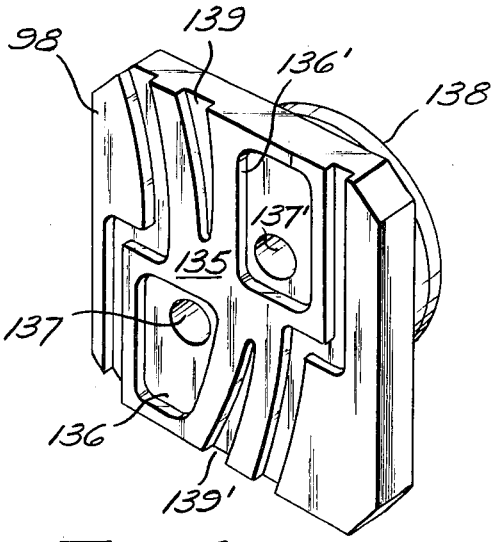
Fig. 6
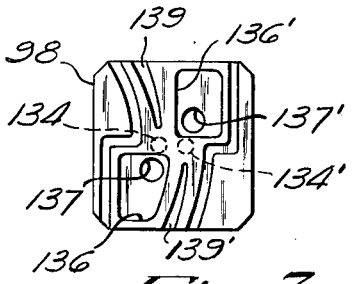
Fig. 7

HORSEPOWER LIMITER CONTROL FOR A VARIABLE DISPLACEMENT PUMP

BACKGROUND OF THE INVENTION

1. Field of the Invention

The instant invention relates generally to variable displacement pumps and more specifically to a horsepower limiter control which automatically limits the maximum pump horsepower to a set amount by adjusting the product of maximum pump working pressure and pump displacement to maintain a constant horsepower.

2. Description of the Prior Art

One prior control for limiting pump horsepower to a preset value, known to applicants, operates by automatically changing the setting of a working pressure sequence or compensator valve as the displacement changes. This control utilizes a pilot flow from working pressure fluid which flows through an adjustable fixed orifice in the sequence valve which orifice sets the pump horsepower limit and provides a constant fluid flow through a variable power limiter control orifice. The power limiter control orifice is downstream of the fixed orifice and varies in size in relation to the displacement setting of the pump. This causes the pressure of the fluid between the two orifices, which fluid acts on the sequence valve remote control connection, to change with the displacement setting. Thus, the setting of the sequence valve varies as the displacement of the pump is changed.

When the pressure and flow of the pump become such that the horsepower set by the fixed orifice is exceeded, the horsepower limiter operates and the sequence valve is spilled. Simultaneously, working pressure fluid is directed to a fluid motor which automatically destrokes the pump until its horsepower is decreased to that set by the fixed orifice.

This control requires a uniform fluid flow from the sequence valve remote control line through the horsepower limiter control orifice during operation of the horsepower limiter, i.e. when the pump horsepower tends to be excessive and the displacement of the pump is automatically reduced, in order to provide an accurate horsepower setting for the valve. Such a uniform flow is difficult to achieve because of tolerances in the dimensions of the sequence valve poppet and seat, because of friction and because of leaks in the valve.

A further disadvantage of the prior system is that the variable horsepower limiter orifice, which is controlled by the position of the rocker cam, i.e. pump displacement, is necessarily extremely small since high pressure working fluid is utilized as the control medium. In this control the contour of the orifice must be precisely manufactured to maintain a constant set horsepower. Since the orifice is very small, it is difficult to precisely manufacture this orifice. Further, the orifice tends to plug up with contaminants in the hydraulic fluid during operation.

SUMMARY OF THE INVENTION

The present invention provides a horsepower limiter control which adjusts the setting of a pump sequence valve in relation to the displacement of the pump. The control utilizes low pressure control fluid which permits the use of relatively large orifices. Parts for large orifices can be made accurately and the large orifices have reduced susceptibility to dirt. Accuracy of the control is further enhanced by the use of a pressure compensator valve in the control which provides a constant fluid flow through the horsepower limiter control orifice and thereby permits the setting of the pump sequence valves to be precisely varied in response to changes in pump displacement.

DESCRIPTION OF THE DRAWINGS

FIG. 1 is a part sectional view of a fluid energy translating device and a portion of a manual displacement control device therefor.

FIG. 2 is a perspective view showing the inner side of a cover plate which houses a manual displacement control device for the fluid energy translating device of FIG. 1.

FIG. 5 is a sectional view of the horsepower limiter control.

FIG. 6 is an isometric view of a horsepower limiter shoe.

FIG. 7 is a plan view of the shoe shown in FIG. 6.

DESCRIPTION OF THE PREFERRED EMBODIMENT

Figure 3:
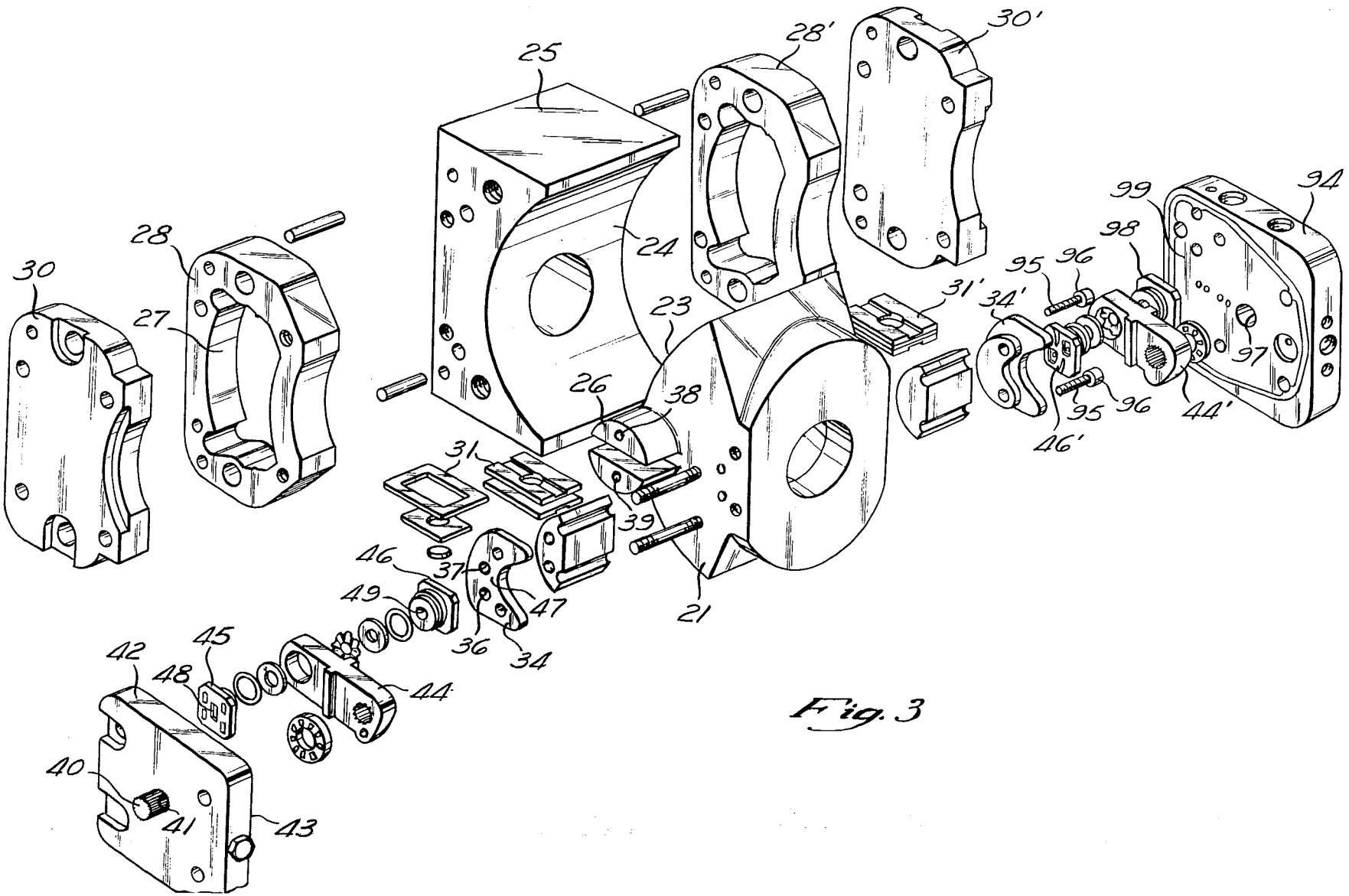
FIG. 3 is an exploded view of the manual displacement control system shown in FIG. 1.

Referring now to FIG. 1, an axial piston pump has a case 11 which includes a central housing 12, an end cap 13 at one end and a port cap, not shown, at the other end. Case 11 may be fastened together by bolts or other known means.

Case 11 has a cavity 14 in which a rotatable cylinder barrel 15 is mounted in a roller bearing 16. Barrel 15 has a plurality of bores 17 equally spaced circumferentially about the rotational axis of the barrel 15. A piston 18 having a shoe 19 is mounted in each bore 17.

Each shoe 19 is retained against a flat creep or thrust plate 20 mounted on a movable rocker cam 21 by a shoe retainer assembly fully described in U.S. Pat. No. 3,904,318 assigned to the assignee of the invention.

Referring again to FIG. 1, rotation of a drive shaft 22 by a prime mover, such as an electric motor, not shown, will rotate barrel 15. If rocker cam 21 and thrust plate 20 are inclined from a neutral or centered (minimum fluid displacement) position normal to the axis of shaft 22, the pistons 18 will reciprocate as the shoes 19 slide over plate 20 in a well known manner. Fluid displacement increases as the inclination of thrust plate 20 increases.

The pump displacement changing mechanism will next be described. Rocker cam 21 has an arcuate bearing surface 23 which is received in a complimentary surface 24 formed on a rocker cam support 25 mounted in end cap 13. Rocker cam 21 which carries thrust plate 20 is moved relative to support 25 by a pair of fluid motors. Although this description refers to the fluid motor on the left side of rocker cam 21 as viewed in FIG. 3 it applies equally to the fluid motor on the right side of rocker cam 21 and identical components will be noted with identical primed numbers.

The fluid motor includes a vane 26 formed integrally with the side of rocker cam 21 so as to be rigidly secured thereto and movable therewith. The vane 26 projects laterally from the side of rocker cam 21 into a vane chamber 27. Chamber 27 is formed by a vane housing 28 which is attached to rocker cam support 25 by bolts 29. A cover 30, shown in FIG. 3, closes the end of housing 28 and is secured by bolts 29. As thus assembled, vane 26 and a seal assembly 31 divide chamber 27 into a pair of expansible fluid chambers 32, 33 to form a fluid motor.

The fluid motor is operated by supplying pressurized fluid to one of the chambers 32, 33 and simultaneously exhausting fluid from the other chamber 32, 33 to move vane 26 within chamber 27. The operation of the fluid motor is controlled by servo or follow-up control valve mechanism which regulates the supply of pressurized fluid to chambers 32, 33. The mechanism includes a fluid receiving valve plate 34 rigidly mounted on rocker cam 21 by bolts 35. Valve plate 34 and vane 26 move along concentric arcuate paths when rocker cam 21 is moved.

Valve plate 34 has a pair of ports 36, 37 which are connected to respective fluid chambers 32, 33 through a pair of drilled passageways 38, 39 which terminate in vane 26 on either side of seal assembly 31.

For counterclockwise operation of the fluid motor, as viewed in FIG. 1, pressure fluid is supplied to port 36 and flows through passageway 38 into chamber 32 to move vane 26 and rocker cam 21 counterclockwise. Expansion of chamber 32 causes chamber 33 to contract and exhaust fluid through passageway 39 out of port 37 and into the pump casing.

For clockwise operation of the fluid motor, the fluid flow is reversed, pressure fluid is supplied to port 37, flows through passageway 39 and expands chamber 33 to move vane 26 and rocker cam 21 clockwise. Chamber 32 contracts and exhausts fluid through passageway 38 out of port 36 and into the pump casing.

Referring to FIGS. 1–3, that portion of a servo control valve mechanism which selectively supplies fluid to ports 36, 37 in valve plate 34 will now be described. An input shaft 40 is mounted in a bore 41 in a cover plate 42. FIG. 2 shows the flat inner surface 43 (i.e. the surface that overlies valve plate 34) of cover plate 42. Cover plate 42 is attached to housing 12 by bolts, not shown. An arm 44 positioned on the inside of cover plate 42 is fastened to input shaft 40. An input valve member includes a pair of identical valve shoes 45, 46 which are received in a bore, not shown, in arm 44. Shoe 45 rides on flat inner surface 43 of cover plate 42 and shoe 46 rides on a flat surface 47 of valve plate 34. Each shoe 45, 46 has a central port 48, 49 respectively which receives servo fluid from a port, not shown, in cover plate 42.

Operation of the fluid motor by the servo control valve mechanism to change the displacement of the pump will now be described. When the fluid motor is at rest fluid port 49 in shoe 46 lies between valve plate ports 36, 37 and the ports are covered by flats on the shoe. To change the displacement of the pump, input shaft 40 is rotated in the direction rocker cam 21 is to pivot. If input shaft 40 is rotated clockwise as viewed in FIG. 1, shoe 46 is moved clockwise and port 49 (which is in fluid communication with port 48 in shoe 45 and the servo fluid supply port in cover plate 42 under all conditions) is aligned with port 37 while port 36 is uncovered. Pressure fluid flows from port 37, through passageway 39 into chamber 33. Simultaneously, fluid exhausts from chamber 32 through passageway 38 and out of uncovered port 36. Rocker cam 21 is pivoted counterclockwise in a similar manner when input shaft 40 is moved counterclockwise to align port 49 with valve plate port 36.

Accurate follow-up is provided since angular movement of rocker cam 21 and valve plate 34 is equal to that of input shaft 40. When rocker cam 21 and valve plate 34 are moved through the same angle as input shaft 40, port 49 is centered between ports 36, 37, flats on shoe 46 cover ports 36, 37 and the fluid motor is stopped.

Figure 4:
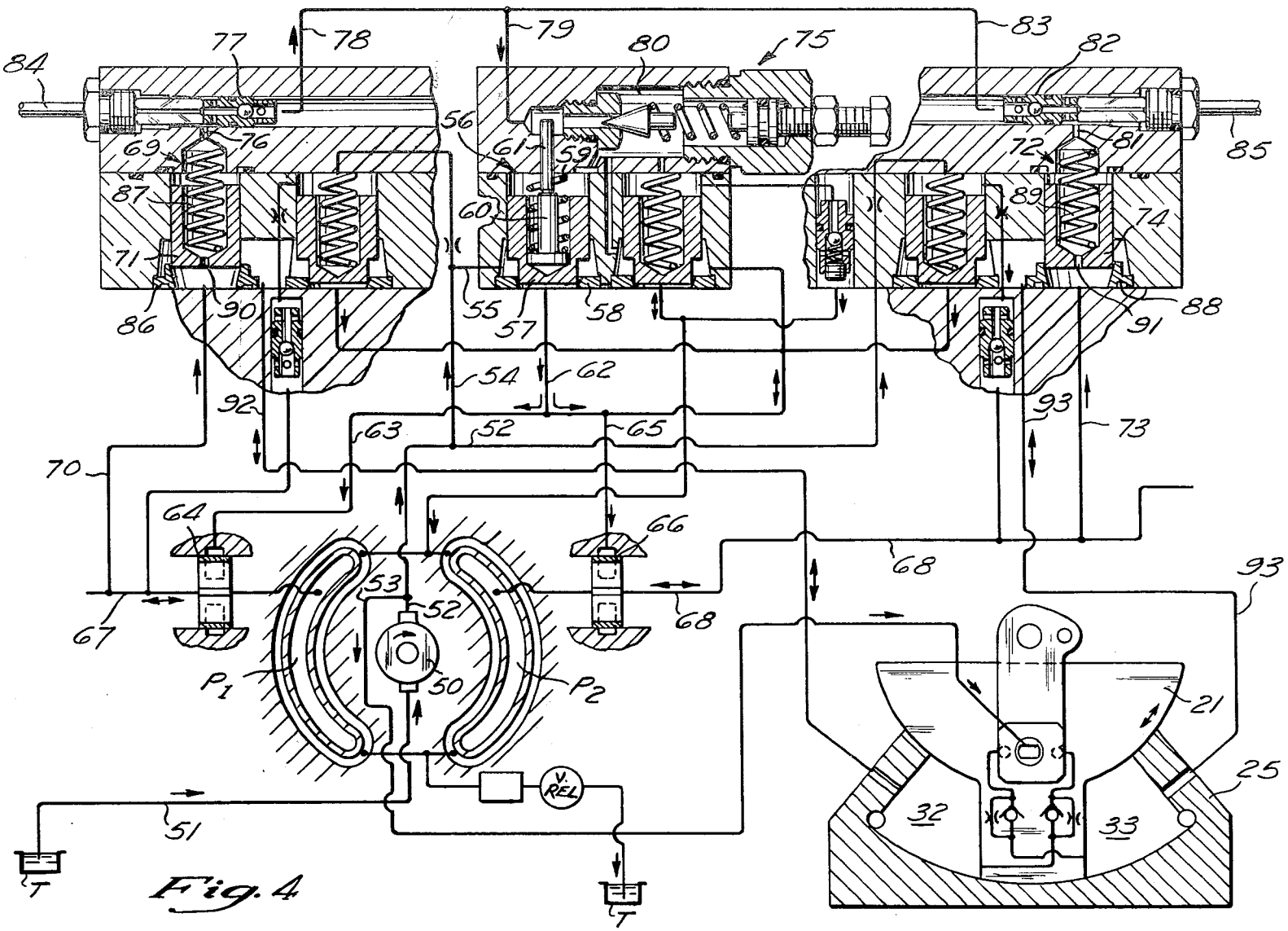
FIG. 4 is a sectional view of the valve block for the automatic control and a schematic diagram of the hydraulic circuitry for the automatic and manual control systems.

The above described manual control system is supplemented by an automatic control system which will now be described. This system is described in greater detail in U.S. Pat. No. 3,908,519 assigned to the assignee of the instant invention and incorporated by reference herein. Referring to FIG. 4, fluid in tank T is supplied to the intake side of servo pump 50 through line 51. Servo pressure fluid is exhausted from pump 50 through lines 52, 53 to the port in cover plate 42 and flows to the manual pump control for operation of the pump displacement control motors as described above.

Lines 54, 55 connect line 52 to a pressure modulated servo relief valve 56 in which servo pressure fluid acts against a poppet 57 which is biased against a seat 58 by both a spring 59 and a plunger 60 operated by a piston 61. Working pressure fluid is supplied to the top of piston 61 so that the force applied by it to plunger 60 and poppet 57 is modulated by variations in the pressure of the working fluid. For example, at a working fluid pressure of 0 psi, relief valve 56 is set at approximately 300 psi, but at a working pressure of 5000 psi, relief valve 56 is set at approximately 500 psi.

When servo fluid pressure exceeds the force of spring 59 and plunger 60, poppet 57 lifts from seat 58 and fluid spills into a replenishing circuit which includes line 62, feed line 63 to check valve 64 and feed line 65 to check valve 66. Check valves 64, 66 are located in respective lines 67, 68 from main pump ports $P_1$, $P_2$. If the low pressure port does not have an adequate supply of fluid, the check valve in that port opens to supply replenishing fluid to prevent cavitation of the pump.

A sequence valve 69 controls working fluid pressure in main pump port $P_1$. Working fluid in port $P_1$ flows out of the pump through line 67 to perform desired work. Lines 67, 70 connect port $P_1$ with the bottom of sequence valve poppet 71. Port $P_2$ is the low pressure inlet port. Sequence valve 72 controls working fluid pressure in main pump port $P_2$. Working pressure fluid in port $P_2$ flows out of the pump through line 68 to perform desired work. Lines 68, 73 connect port $P_2$ with the bottom of sequence valve poppet 74.

An adjustable pilot stage 75 which controls the pressure setting of the sequence valves 69, 72 is connected to an orifice 76 in the top of valve 69 through a check valve 77, line 78, line 79 and cavity 80. Pilot stage 75 is connected to orifice 81 in the top of valve 72 through a check valve 82, line 83, line 79 and cavity 80. A first auxiliary line 84 is connected in parallel with pilot stage 75 to the top of orifice 76 in valve 69. A second auxiliary line 85 is connected in parallel with pilot stage 75 to orifice 81 in the top of valve 72. Auxiliary lines 84, 85 are connected to a horsepower limiter control which provides a second setting for the valves 69, 72 connected to the working fluid port as will be described hereinafter.

Sequence valve 69 includes poppet 71 biased against a seat 86 by spring 87. Sequence valve 72 includes poppet 74 biased against a seat 88 by a spring 89. When port $P_1$ has working fluid, the fluid passes through an orifice 90 in poppet 71 of valve 69 and orifice 76 to reach pilot stage 75 and line 84. When port $P_2$ has working fluid, the fluid passes through an orifice 91 in poppet 74 of valve 72 and orifice 81 to reach pilot stage 75 and auxiliary line 85.

When working fluid pressure in port $P_1$ spills pilot stage 75 or unblocks line 84 as described hereinafter, fluid flows through the orifices 90, 76 above poppet 71 and reduces the pressure on top of the poppet 71. Working fluid lifts poppet 71 from seat 86 and spills through the valve. Some of the spilled working fluid flows through line 92 to fluid motor chamber 32 and operates the fluid motor to move rocker cam 21 towards the neutral position to reduce the displacement of the pump until working fluid pressure is just sustained at the setting of valve 69.

Likewise, when excessive working fluid pressure in port $P_2$ spills pilot stage 75 or unblocks line 85, described below, fluid flows through the orifices 91, 81 and reduces the pressure on top of poppet 74. This allows working fluid to lift poppet 74 from seat 89 and spill through the valve 72. Some of the spilled fluid flows through line 93 to fluid motor chamber 32 and operates the fluid motor to reduce the displacement of the pump until working fluid pressure is just sustained at the setting of valve 72.

From the foregoing, it can be seen that sequence valve 69 is set by pilot stage 75 and by a horsepower limiter device in line 84 described below. Likewise, sequence valve 72 is set by pilot stage 75 and a horsepower limiter device in line 85 described below. Whenever the setting of one of the sequence valves 69, 72 is exceeded, the valve spills working pressure fluid and some of the spilled fluid flows to the fluid motor and reduces the displacement of the pump until working fluid pressure is just sustained at the lowest setting of the valve 69, 72.

A horsepower limiter control housing 94 is mounted on the right side of rocker cam 21 opposite servo control valve cover plate 42 as shown in FIG. 3. A second valve plate 34' is secured to the right side of rocker cam 21 by bolts 95. Bolt heads 96 capture arm 44' which pivots on a shaft, not shown, mounted in bore 97 of housing 94 and force it to move when cam 21 moves. Arm 44' pivots about the same axis as rocker cam 21 and its angular position is representative of the pump displacement.

Arm 44' carries a shoe 46' which is identical to valve shoes 45, 46, and rides against plate 34' and a horsepower limiter shoe 98 which rides against bottom surface 99 of housing 94. The horsepower limiter shoe 98 differs from the valve shoe 46' and will be described in detail hereinafter.

The horsepower limiter control in the instant invention works in conjunction with the manual and hydraulic control systems described above and limits the horsepower of the pump so that the maximum torque of the prime mover is not exceeded. The control is manually adjustable to enable a maximum pump horsepower to be selected. After the control is set, it automatically varies the setting of a sequence valve associated with the pump working pressure port to maintain the set horsepower limit. If the working pressure reaches the setting of the sequence valve, fluid spilled through the valve flows to the hydraulic pump displacement control motors to automatically reduce the pump displacement the correct amount to limit the working fluid pressure to the setting of the sequence valve.

The horsepower limiter control housing 94, shown in detail in FIG. 5, is nearly symmetrical; the components on one side of the center line provide a horsepower limiter control when the rocker cam is on one side of center and one pump port is the working port and the components on the other side of the center line provide a horsepower limiter control when the rocker cam is on the other side of center and the other pump port is the working port. Each set of components is individually adjustable to limit the pump horsepower. Identical components on one side of the housing center line will be identified by identical primed numbers with those on the opposite side. Housing 94 has a stepped central bore 100 which contains a hollow slotted pin 101 in the reduced diameter portion and a filter 102 in the enlarged diameter portion of the bore. A threaded cap 103 seals the end of bore 100 and retains a spring 104 which positions filter 102 in bore 100. Servo fluid from an auxiliary servo pump, not shown, enters bore 100 through a bore, not shown, which bore breaks into bore 100 on the outside of filter 102. Servo fluid passes to the inside of the filter and through filter bore 105 to a stepped passage 106 which supplies servo fluid to components on both sides of housing 94. Passage 106 is closed by a plug 107.

For this description, it will be assumed that the rocker cam is on one side of center and the pump is controlled by the operation of the components on the lower half of the control housing 94 as viewed in FIG. 5. Servo fluid in passage 106 flows past a manually adjustable orifice 108 in a bore 109. The size of orifice 108 is controlled by a threaded member 110 which is locked in position by a sealing type nut 111 and further protected by a cap nut 112. The area of orifice 108 determines the amount of fluid flowing through the horsepower limiter control and thereby sets the horsepower limit of the pump as explained hereinbelow.

Downstream of orifice 108, the servo fluid flows through bore 113 to a variable orifice 114 created by a pressure compensator spool 115 in a bore 116 which intersects bore 113 and extends through housing 94. A plug 117 acting on a spring 118 closes bore 116 and urges spool 115 towards pin 101.

Servo fluid in bore 100 flows past pin 101 and acts on the bottom end 119 of spool 115. Servo fluid in bore 109 downstream of orifice 108 flows through a bore 120 in spool 115 which intersects a central bore 121 connected to the top end 122 of spool 115.

The fluid pressure downstream of orifice 108 and acting on the top end 122 of spool 115 is at less pressure than the servo fluid acting on bottom end 119. If servo fluid pressure tends to build up such that the pressure drop across orifice 108 causes the spool 115 to shift outwardly, the controlled fluid flow rate is maintained by regulating the spool position until the pressure differential across spool 115 just equals the force of spring 118. From the above, it can be seen that the pressure compensator spool 115 assures a constant flow of control fluid corresponding to a setting of orifice 108 to a bore 123, even though upstream or downstream pressures may vary. The orifice 108 and spool 115 work together to provide the results of a typical pressure compensated flow control valve.

Downstream of the pressure compensator, the fluid in bore 123 flows to an intensifier piston 124 slidably mounted in a bore 125 which intersects bore 123. Bore 125 is closed by a fitting 126 which has a small bore 127 connected via line 84 to the downstream side of orifice 76 adjacent sequence valve 69. Piston 124 has a projection 128 which mounts a poppet 129 which seals or restricts bore 127 when piston 124 is moved outwardly.

A portion of the control fluid flows through the slight clearance gap between piston 124 and the bore 125 to the bottom end 130 of the piston, and the pressure at the bottom end of piston 124 becomes equal to the pressure in bore 123, which is at a controlled pressure. The mechanism for controlling this pressure is described hereinafter. The head end 131 of the piston 124 is in a chamber which is connected via a drain line, not shown, to case. Therefore, fluid at controlled pressure, equal to the pressure in bore 123, biases piston 124 into the sealing or restricting position.

Since the area of the bottom end 130 of piston 124 is much greater than the area of bore 127, a relatively low controlled fluid pressure acting on end 130 will seal or restrict bore 127 even when it is exposed to a much higher working fluid pressure. The ratio of the area of end 130 on piston 124 to that of bore 127 determines the maximum working fluid pressure which will be controlled by the fluid pressure in bore 123. In this invention, a ratio of 16:1 has been found satisfactory. Therefore, if controlled fluid pressure is 100 psi, working pressure fluid in bores 84 and 127 will unseat poppet 129, and allow sequence valve 69 to spill at 1600 psi.

Downstream of piston 124, the controlled fluid flows into an intersecting bore 132 which is sealed at one end by a plug 133. The other end of bore 132 intersects a port 134 connected to the inside surface 99 of control housing 94 as seen in FIG. 3. Port 134 provides an escape for the controlled fluid from housing 94 into the pump case, which is drained. Restriction of the rate of fluid flow from port 134 causes a back pressure on the fluid in bores 132, 123 which sets the controlled pressure level of the fluid acting on intensifier piston 124 and thereby sets the pressure at which sequence valve 69 will spill.

When the pump is in the neutral position, i.e. not displacing any fluid, port 134 is substantially covered by a flat, central portion 135 of horsepower limiter shoe 98, as best seen in FIGS. 4–6. However, in this position, port 134 breaks into a pocket 136 which is connected by a bore 137 to the top 138 of shoe 98. Likewise, port 134' breaks into pocket 136' when the pump is in the neutral position. The pressure fluid in pockets 136, 136' flows through respective passages 137, 137' to the top 138 and thrusts shoe 98 against inner surface 99 of housing 94 to prevent leakage and to provide an accurate area for a variable orifice formed between the shoe 98 and surface 99 described below. One or the other pockets 136, 136' are always in fluid communication with ports 134, 134' through all angular positions of shoe 98 to provide continuous hydraulic thrusts of shoe 98 against housing 94. When ports 134, 134' are out of fluid communication with their respective grooves 139, 139', the ports are blocked, no fluid can escape from passages 132, 132' and fluid at maximum servo pressure acts on the end 130 of intensifier piston 124 to seal bore 127 and provide the maxium setting of sequence valves 69 and 72 and to adequately thrust shoe 98 against inner surface 99.

When rocker cam 21 is on one side of center, one of the ports 134, 134' (high pressure) is aligned with its respective groove 139, 139' to form an orifice which creates a back pressure as described above. Simultaneously, the other port 134, 134' (low pressure) is aligned with its respective pocket 136, 136' and there is no fluid flow from the low pressure port 134, 134'. Therefore, the sequence valve associated with the (low pressure), port is at its maximum setting. Having the sequence valve in the low pressure port at its maximum setting is important since sometimes a workload will drive a pump and its prime mover. When this happens the high and low pressure pump ports see low and high pressure fluid respectively although fluid flow is in the same direction. If high pressure fluid could spill the sequence valve normally associated with low pressure fluid under this condition the fluid motor would increase displacement of the pump. This would enable the work load to run out of the control of the servo control valve.

However, in the instant invention the rocker cam positions the horsepower limiter shoe which always sets the sequence valve for the low pressure port at its maximum setting. If the work load begins to drive the pump and prime mover and the high and low pressure ports carry low and high pressure fluid respectively, the high pressure fluid is controlled by a sequence valve at its maximum setting. Since the sequence valve cannot spill, the pump displacement remains unchanged. This allows the load to be controlled by the servo control valve mechanism described above.

In order to limit pump horsepower to a desired maximum, as the working fluid pressure increases, the displacement (flow) must decrease proportionally. This is apparent from the following equation which expresses the relationship of flow and pressure with respect to horsepower: pump horsepower = .000583 × pressure (pounds per square inch) × flow (gallons per minute). The instant horsepower limiter operates by automatically adjusting the pump displacement as the working fluid pressure changes to maintain the product of pump displacement and maximum working fluid pressure constant.

In this invention, the controlled pressure of the fluid acting on the intensifier piston 124 changes inversely with the displacement of the pump to thereby change the setting of the sequence valve. Referring again to FIGS. 4–6, it can be seen that port 134 is aligned with an arcuate groove 139 in shoe 98. Port 134 in conjunction with groove 139 provides a second adjustable orifice. Since the degree of restriction between port 134 and groove 139 changes with changes in the pump displacement setting mechanism, and since the rate of fluid flow through the variable orifice is constant as controlled by flow controlling orifice 108 and pressure compensator spool 115, then the resulting back pressure is controlled relative to pump displacement. This controlled pressure, acting on the intensifier piston 124, controls the setting of the sequence valve.

Groove 139 must be sized and shaped such that for any angular position of shoe 98 the resulting orifice is sized so that the product of the controlled low pressure and pump displacement is constant, which will assure that the product of the sequence valve setting and pump displacement is constant. In this invention the displacement of the pump is proportional to the tangent of the angle between the horsepower limiter shoe 98 and the pump axis.

In order to determine the areas of the second adjustable orifice, two formulas are necessary. The first formula is: the controlled low pressure (in pounds per square inch) for a set horsepower = a constant divided by the tangent of the rocker cam angle. (psi = ($k$/tan 0)). As previously stated, the displacement of the pump is directly proportional to the tangent of the rocker cam angle.

The second formula states that orifice area equals flow (gallons per minute) of fluid flowing through the orifice divided by 29 times the square root of controlled low pressure (psi) corresponding to a particular angle of the rocker cam.

$$A_o = \frac{\text{gpm}}{29\sqrt{\text{psi}}}.$$

Using the above formulas, the following steps are necessary to determine the proper orifice area. First, the maximum flow in gallons per minute of the pump to which the instant horsepower limiter control is mounted is determined. Normally the maximum flow in gallons per minute can easily be calculated if the displacement of the pump and the shaft speed of the prime mover are known. Next, the maximum system pressure at the above flow rate is determined for a selected horsepower. The system pressure can be found using the formula: horsepower = .000583 × (psi) working system pressure × (gpm) working fluid flow. It should be noted that the formulas used here make no allowance for losses and ineffeciency in the pumps. In actual practice, allowance is made in the design of the control to correct for these inefficiencies. The system pressure is based on limiting the horsepower to that available from the prime mover. From the same formula, the maximum system pressure at each angle of the rocker cam (which determines working fluid flow) can be determined.

The maximum working or system pressure for each rocker cam angle is then divided by the intensification ratio, i.e. the ratio of the area of intensifier piston 124 to that of bore 127 restricted by the piston, to determine the controlled pressure which must be supplied to the bottom end 130 of the intensification piston 124 to set the sequence valve at the maximum allowable working pressure at each angle.

It is necessary to select a desired flow of controlled fluid from the pressure compensator spool 115 to the intensifier piston 124. This is flow controlled by adjusting orifice 108, and will remain constant for any selected horsepower. Next, since the necessary controlled pressure (psi) for each rocker cam angle is determined, the shoe orifice area is calculated for each rocker cam angle using the formula:

$$A_o = \frac{\text{gpm}}{29\sqrt{\text{psi}}}.$$

Finally, using a constant depth orifice slot, the orifice width is determined for each angle. This results in a generated area for manufacturing the orifice slot. An important feature of the subject invention is that the relationship of areas of the orifice at all cam angles is correct for all horsepower settings, and to adjust the control for a different horsepower limit it is necessary to merely adjust orifice 108 to provide a different constant flow rate. This feature makes it possible to use a single control for any size pump.

When a new flow rate is set corresponding to a new horsepower limit, the new level of controlled fluid pressures can be calculated at each angle by the formula:

$$\text{PSI} = \left(\frac{\text{gpm}}{29 \times A_o}\right)^2$$

By using the area of the shoe orifice designed by the steps outlined previously with this equation, it will be seen that the relationship of the controlled fluid pressure at each angle remains constant, although the values change at the new selected flow rates. The horsepower limiter will yield a flat horsepower curve for all horsepower limits within the practical range of any size pump on which this control is used. This feature is considered to be unique to this design.

Since identical horsepower limiter shoes are used in all horsepower limiter controls, it has been found practical to tool this part from powdered metal which lowers the cost of production and provides uhiformity of dimensions.

Obviously, those skilled in the art may make various changes in the details and arrangements of parts without departing from the spirit and scope of the invention as it is defined by the claims hereto appended. Applicants, therefor, wish not to be restricted to the precise construction herein disclosed.

Having thus described and shown one embodiment of the invention, what is desired to secure by Letters Patent of the United States is:

1. A variable displacement pump driven by a prime mover, comprising fluid motor means for setting the displacement of the pump, manual conrtrol mean for operating the fluid motor means to set the displacement at a desired value, adjustable valve means for limiting working fluid pressure, means for automatically reducing pump displacement when working fluid pressure equals the setting of said valve means and a horsepower limiter control for preventing the torque required from the prime mover from exceeding a pre-selected value, said horsepower limiter control including a source of low pressure fluid, a fluid passage for said low pressure fluid, means for channeling said low pressure fluid at a selected uniform flow rate through a variable orifice in said fluid passage, said variable orifice creating a variable fluid back pressure upstream of said variable orifice, means for adjusting said variable orifice by movement of the pump displacement varying mechanism, wherein the variable orifice is contoured to provide a variable area such that the low pressure fluid will have a back pressure-pump displacement relationship such that the product of the back pressure times the pump displacement remains constant, including an intensifier piston having one end exposed to the fluid back pressure, second valve means set by said intensifier piston for adjusting the working fluid pressure setting of the first said valve means, said intensifier piston having a constant area ratio such that the product of the first said valve means pressure setting times the pump displacement is constant.

2. A variable displacement pump as set forth in claim 1, wherein said fluid passage terminates in a port which breaks into a flat surface, said adjusting means includes a shoe having a face which rides on said flat surface, said orifice includes a variable area groove formed in said shoe face, and said groove is aligned with the port to permit the flow of low pressure fluid in the fluid passage when the pump has working fluid in one port.

3. A variable displacement pump as set forth in claim 2, wherein said shoe includes means for blocking said port to prevent the flow of low pressure fluid in the fluid passage when the pump is not displacing fluid or has working fluid in the other port and said fluid back pressure is at a maximum when said port is blocked.

4. A variable displacement pump as set forth in claim 3, wherein said shoe includes a pocket which collects said low pressure fluid from said port when the pump is not displacing fluid or has working fluid in the other port, second fluid passage means connecting said pocket and the top of the shoe, wherein the low pressure fluid acts on the top of the shoe to clamp the face against said flat surface to prevent leakage of said low pressure fluid.

5. A variable displacement pump as set forth in claim 1, including means for selecting a flow rate for said low pressure fluid to thereby limit the pump horsepower and said selecting means includes a second adjustable orifice located in said fluid passage.

6. A variable displacement pump as set forth in claim 5, wherein said means for channeling low pressure fluid at a uniform flow rate includes a pressure compensated piston which controls the pressure drop across the second adjustable orifice and provides a uniform low pressure flow rate in said fluid passage.

7. A variable displacement pump as set forth in claim 1, wherein said pump operates between a position of maximum displacement in one direction in which one port is the working port and the other port is the inlet port and a position of maximum displacement in the other direction in which the other port is the working port and said one port is the inlet port, said horsepower limiter control is operative when said pump is displacing fluid in said one direction and including a second horsepower limiter control operative when the pump is displacing fluid in said other direction.

8. A variable displacement pump as set forth in claim 7, wherein said first horsepower limiter includes a second adjustable orifice for selecting a low pressure fluid flow rate to limit the pump horsepower when the pump is displacing fluid in the one direction, said second horsepower limiter includes a third adjustable orifice for selecting a low pressure fluid flow rate to limit the pump horsepower when the pump is displacing fluid in the other direction and said second and third adjustable orifices are independently adjustable to provide different horsepower limits for different directions of fluid displacement.

9. A variable displacement pump driven by a prime mover, comprising fluid motor means for setting the displacement of the pump, means for operating the fluid motor to set the displacement at a desired value, adjustable valve means for limiting working fluid pressure by automatically operating the fluid motor to reduce pump displacement when working fluid pressure equals the setting of said valve means and a horsepower limiter control for preventing the torque required from the prime mover from exceeding a pre-selected value, said horsepower limiter control including servo fluid flow having a selected uniform rate irrespective of variations in pressure at its source, a variable orifice, means for channeling said servo fluid flow through the variable orifice, fluid back pressure upstream of said variable orifice, said fluid back pressure setting the pressure level at which said valve means will operate, means for adjusting said variable orifice by movement of the pump displacement varying mechanism, wherein the contour of the variable orifice is formed to provide a back pressure-displacement relationship such that the product of the back pressure times the pump displacement remains constant, wherein said variable orifice has a contoured recess in a flat surface of the valve member which is moved by the displacement changing mechanism, the effective area of said variable orifice is the cross sectional area of the recess adjacent of said channeling means.

10. A variable displacement pump driven by a prime mover, comprising fluid motor means for setting the displacement of the pump, means for operating the fluid motor to set the displacement at a desired value, adjustable valve means for limiting working fluid pressure, means for automatically reducing pump displacement when working fluid pressure equals the setting of said valve means and a horsepower limiter control for preventing the torque required for the prime mover from exceeding a pre-selected value, said horsepower limiter control including a source of low pressure fluid, a fluid passage for said low pressure fluid means for channeling said low pressure fluid at a selected uniform flow rate through a variable orifice in said fluid passage, said variable orifice creating a variable fluid back pressure upstream of said variable orifice, means for adjusting said variable orifice by movement of the pump displacement varying mechanism, wherein the contour of the variable orifice is formed to provide a fluid back pressure-displacement relationship such that the product of the back pressure times the pump displacement remains constant, means for intensifying the pressure of the low pressure fluid and means for changing the setting of said valve means in direct relation to changes in the pressure of the low pressure fluid such that the product of the valve means pressure setting times the pump displacement is constant.

11. A variable displacement pump as set forth in claim 10, wherein said intensifying means includes an intensifier piston and said intensifier piston has one end connected to the back pressure fluid and another end connected to working fluid pressure.

* * * * *